US011843173B2

(12) United States Patent
Liu et al.

(10) Patent No.: US 11,843,173 B2
(45) Date of Patent: Dec. 12, 2023

(54) ANTENNA MODULE AND WIRELESS TRANSCEIVER DEVICE

(71) Applicant: WISTRON NEWEB CORPORATION, Hsinchu (TW)

(72) Inventors: Chih-Hsiang Liu, Hsinchu (TW); Tsun-Che Huang, Hsinchu (TW); Wei-Tung Yang, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 57 days.

(21) Appl. No.: 17/505,726

(22) Filed: Oct. 20, 2021

(65) Prior Publication Data

US 2022/0416435 A1 Dec. 29, 2022

(30) Foreign Application Priority Data

Jun. 25, 2021 (TW) ..... 110123243

(51) Int. Cl.
*H01Q 21/00* (2006.01)
*H01Q 9/04* (2006.01)
*H01Q 3/26* (2006.01)

(52) U.S. Cl.
CPC ..... *H01Q 21/0006* (2013.01); *H01Q 3/26* (2013.01); *H01Q 9/0407* (2013.01)

(58) Field of Classification Search
CPC .... H01Q 21/0006; H01Q 3/26; H01Q 9/0407; H01Q 21/065; H01Q 21/24; H01Q 21/245
See application file for complete search history.

(56) References Cited

U.S. PATENT DOCUMENTS 3,681,769 A * 8/1972 Perrotti ..... H01Q 21/062 343/822
4,054,874 A * 10/1977 Oltman, Jr. ..... H01Q 9/0457 343/797
4,173,019 A * 10/1979 Williams ..... H01Q 21/062 343/846

(Continued)

FOREIGN PATENT DOCUMENTS

CN 1248363 C * 3/2006 ..... H01Q 1/38
CN 209298563 U * 8/2019

(Continued)

*Primary Examiner* — Dimary S Lopez Cruz
*Assistant Examiner* — Jordan E. DeWitt
(74) *Attorney, Agent, or Firm* — McClure, Qualey & Rodack, LLP

(57) ABSTRACT

An antenna module and a wireless transceiver device are provided. The wireless transceiver device includes an antenna module. The antenna module includes a circuit board and at least one antenna array. The at least one antenna array defines a midline. The at least one antenna array includes a plurality of antenna elements and a signal feeding line. Each antenna element includes a feeding branch and a radiating portion. The radiating portion is coupling to the feeding branch, and the radiating portion is exposed on the upper surface of the circuit board. The signal feeding line is arranged in the circuit board and is perpendicular to the midline, and the signal feeding line is coupling to the feeding branch. The radiating portion defines an extension line along its extension direction. There is an included angle between the extension line and the midline.

18 Claims, 9 Drawing Sheets

(56) References Cited

U.S. PATENT DOCUMENTS 4,356,492 A * 10/1982 Kaloi ..... H01Q 9/0407 343/846
5,793,330 A * 8/1998 Gans ..... H01Q 21/24 343/756
5,859,616 A * 1/1999 Gans ..... H01Q 21/245 343/846
6,317,095 B1 * 11/2001 Teshirogi ..... H01Q 13/10 343/770
6,424,298 B1 * 7/2002 Nishikawa ..... H01Q 21/065 343/700 MS
6,999,030 B1 * 2/2006 Mateychuk ..... H01Q 21/065 343/846
7,053,833 B2 * 5/2006 Hsu ..... H01Q 1/38 428/209
7,636,064 B2 * 12/2009 Shi ..... H01Q 21/12 343/700 MS
8,471,775 B2 * 6/2013 Nakabayashi ..... H01Q 21/0075 343/731
8,736,514 B2 * 5/2014 Nakabayashi ..... H01Q 3/22 343/893
9,236,664 B2 * 1/2016 Hayakawa ..... H01Q 9/045
9,728,855 B2 * 8/2017 Wang ..... H01Q 21/205
9,768,512 B2 * 9/2017 Park ..... H01Q 1/48
9,871,300 B1 * 1/2018 Lee ..... H01Q 9/0471
10,418,714 B2 * 9/2019 Liao ..... H01Q 1/48
10,854,965 B1 * 12/2020 Livadaru ..... H01Q 21/0075
2005/0110699 A1 * 5/2005 Timofeev ..... H01Q 1/245 343/797
2006/0033671 A1 * 2/2006 Chan ..... H01Q 21/0093 343/768
2008/0049112 A1 * 2/2008 Lee ..... H04N 23/843 348/222.1
2009/0009400 A1 * 1/2009 Kim ..... H01Q 9/0407 343/700 MS
2009/0046029 A1 * 2/2009 Nagai ..... H01Q 9/045 343/700 MS
2009/0195471 A1 * 8/2009 Semonov ..... H01Q 1/246 343/810
2010/0127949 A1 * 5/2010 Shimizu ..... H01Q 21/08 343/893
2010/0177011 A1 * 7/2010 Sego ..... H01Q 21/065 29/601
2014/0145909 A1 * 5/2014 Chen ..... H01Q 21/08 343/893
2014/0203960 A1 * 7/2014 Huang ..... G01S 7/034 342/175
2014/0203968 A1 * 7/2014 Hsu ..... H01Q 21/0006 342/374
2015/0029072 A1 * 1/2015 Huang ..... H01P 5/12 333/128
2015/0318621 A1 * 11/2015 Apostolos ..... H01Q 3/34 343/776
2015/0349412 A1 * 12/2015 Kim ..... H01Q 21/0006 343/893
2016/0006132 A1 * 1/2016 Lee ..... H01Q 21/065 343/835
2016/0036130 A1 * 2/2016 Hsu ..... H01Q 9/0407 343/848
2016/0134021 A1 * 5/2016 Helander ..... H01Q 1/528 343/893
2016/0322714 A1 * 11/2016 Ying ..... H01Q 9/0407
2017/0117638 A1 * 4/2017 Kim ..... H01Q 21/08
2017/0338558 A1 * 11/2017 West ..... H01Q 21/0025
2018/0017666 A1 * 1/2018 Kato ..... G01S 7/4052
2018/0054006 A1 * 2/2018 Wang ..... H01Q 21/24
2018/0076530 A1 * 3/2018 Kawahata ..... H01Q 21/08
2018/0097558 A1 * 4/2018 Girnyk ..... H04B 7/0469
2018/0212307 A1 * 7/2018 Kim ..... H05K 1/00
2018/0267139 A1 * 9/2018 Park ..... H01Q 1/3233
2018/0358709 A1 * 12/2018 You ..... H01Q 21/064
2019/0036220 A1 * 1/2019 Paulotto ..... H01Q 9/045
2019/0067832 A1 * 2/2019 Yoshitake ..... H01Q 21/0075
2019/0165476 A1 * 5/2019 Hong ..... H01Q 21/065
2019/0379120 A1 * 12/2019 Manasson ..... H01Q 21/245
2019/0393616 A1 * 12/2019 Pelletti ..... H01Q 21/065
2020/0036083 A1 * 1/2020 Kim ..... H01Q 21/08
2020/0106184 A1 * 4/2020 Fabrega Sanchez .. H01Q 9/285
2020/0203841 A1 * 6/2020 Izadian ..... H01Q 21/24
2020/0227835 A1 * 7/2020 Kim ..... H01Q 21/065
2020/0358182 A1 * 11/2020 Klemmer ..... H01Q 3/26
2021/0005978 A1 * 1/2021 Pourmousavi ..... H01Q 21/065
2021/0083380 A1 * 3/2021 Takayama ..... H01Q 9/0428
2021/0091473 A1 * 3/2021 Lee ..... H01Q 1/243
2021/0143535 A1 * 5/2021 Watanabe ..... H01Q 9/0414
2021/0167519 A1 * 6/2021 Ichihara ..... H01Q 1/36
2021/0175609 A1 * 6/2021 Ryoo ..... H01Q 1/2283
2021/0376461 A1 * 12/2021 Dallal ..... H01Q 3/2658

FOREIGN PATENT DOCUMENTS

CN 110770974 A * 2/2020 ..... H01Q 1/523
CN 113659325 A * 11/2021
CN 114725667 A * 7/2022
CN 115428262 A * 12/2022 ..... H01Q 13/206
EP 1940019 A1 * 7/2008 ..... H03F 1/3241
EP 3627551 A1 * 3/2020 ..... H01L 23/4824
EP 4068612 A1 * 10/2022 ..... H02M 7/003
FR 2893451 A1 * 5/2007 ..... H01Q 21/0043
GB 2510144 A * 7/2014 ..... H01Q 1/48
JP 2004260554 A * 9/2004
JP 2004343300 A * 12/2004
JP 2010178244 A * 8/2010
JP 2010226165 A * 10/2010
KR 20090082146 A * 7/2009
KR 20200067853 A * 6/2020
TW 201803211 A * 1/2018 ..... H01Q 1/48
TW I706598 B 10/2020
TW 765755 B1 * 5/2022 ..... H01Q 21/0006

* cited by examiner

ANTENNA MODULE AND WIRELESS TRANSCEIVER DEVICE

CROSS-REFERENCE TO RELATED PATENT APPLICATION

This application claims the benefit of priority to Taiwan Patent Application No. 110123243, filed on Jun. 25, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna module and a wireless transceiver device, and more particularly to an antenna module and a wireless transceiver device having dual polarization directions with mutually orthogonal to each other.

BACKGROUND OF THE DISCLOSURE

In the prior art, in order to realize the radiation pattern having dual polarization directions, such as the vertical polarization direction and the horizontal polarization direction, two different types of radiating antennas are usually used for matching. For example, to generate a radiation pattern in a vertical polarization direction, a patch antenna is usually used as a radiator; to generate a radiation pattern in a horizontal polarization direction, a slot antenna is usually used. However, different types of radiators need to be adjusted during matching to achieve an ideal radiation pattern, which usually takes a long time and cost.

Therefore, how to overcome the above-mentioned shortcomings through the improvement of antenna design and realize the radiation pattern of dual polarization directions in the same structure has become one of the important issues to be solved in this field.

SUMMARY OF THE DISCLOSURE

The present disclosure provides an antenna module and a wireless transceiver device.

In one aspect, the present disclosure is to provide an antenna module. The antenna module includes a circuit board and at least one antenna array. The circuit board has a multi-layer board structure. At least one antenna array defines a midline, and the at least one antenna array includes a plurality of antenna elements and a signal feeding line. Each of the plurality of antenna elements includes a feeding branch and a radiating portion. The feeding branch is disposed on the circuit board, the radiating portion is connected to the feeding branch and disposed on the circuit board. The radiating portion is exposed on an upper surface of the circuit board. The signal feeding line is disposed on the circuit board and is perpendicular to the midline. The signal feeding line is coupling to the feeding branch. When a signal is provided by a signal source and fed into the at least one antenna array through the signal feeding line, the at least one antenna array generates a radiation pattern. An extension direction along the radiating portion defines an extension line. There is an included angle between the extension line and the midline.

In another aspect, the present disclosure is to provide a wireless transceiving device. The wireless transceiving device includes at least one circuit board, a first antenna module and a second antenna module. The first antenna module and the second antenna module respectively define a midline. The first antenna module and the second antenna module are disposed on the at least one circuit board. The first antenna module and the second antenna module respectively include at least one antenna array. The at least antenna array includes a plurality of antenna elements and a signal feeding line. Each of the plurality of antenna elements includes a feeding branch and a radiating portion. The feeding branch is disposed on the circuit board. The radiating portion is connected to the feeding branch and is disposed on the circuit board. The radiating portion is exposed on an upper surface of the circuit board. The signal feeding line is disposed on the circuit board and is perpendicular to the midline. The signal feeding line is coupling to the feeding branch. When a signal is provided by a signal source and fed into the at least one antenna array of the first antenna module through the signal feeding line of the first antenna module, the at least one antenna array of the first antenna module generates a first radiation pattern. When another signal is provided by the signal source and fed into the at least one antenna array of the second antenna module through the signal feeding line of the second antenna module, the at least one antenna array of the second antenna module generates a second radiation pattern. A polarization direction of the second radiation pattern is orthogonal to a polarization direction of the first radiation pattern. A first extension direction along the radiating portion of the at least one antenna array of the first antenna module defines a first extension line. A second extension direction along the radiating portion of the at least one antenna array of the second antenna module defines a second extension line. There is an included angle of 90 degrees between the first extension line and the second extension line.

One of the beneficial effects of the present disclosure is that the antenna module provided by the present disclosure can adopt the technical solution of "the radiating portion defines an extension line along its extension direction, and there is an angle between the extension line and the midline", In this way, the antenna module can generate radiation patterns with different polarization directions based on the same architecture, saving the time and cost required for antenna fine-tuning.

One of the beneficial effects of the present disclosure is that the wireless transceiving device provided by the present disclosure can utilize "the first antenna module and the second antenna module are both disposed on at least one circuit board, and the first antenna module and the second antenna module includes at least one antenna array, the at least one antenna array includes a plurality of antenna elements and a signal feeding line" and "a first extension direction along the radiating portion of the at least one antenna array of the first antenna module defines a first extension line, a second extension direction along the radiating portion of the at least one antenna array of the second antenna module defines a second extension line, and there is an included angle of 90 degrees between the first extension line and the second extension line" technical solution, so that the first antenna module and the second antenna module can generate dual-polarization radiation patterns based on the same architecture, saving the time and cost of antenna fine-tuning.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
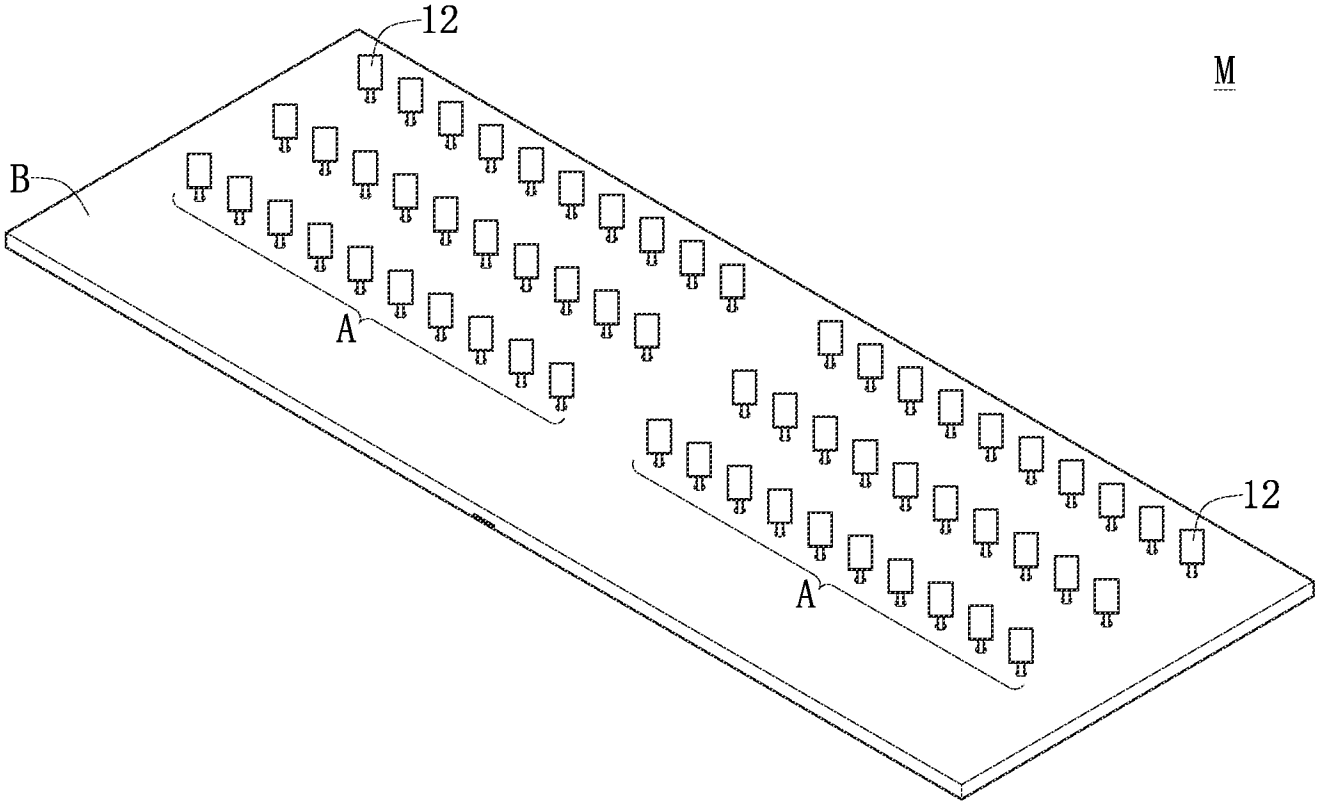
FIG. 1 is a three-dimensional schematic view of an antenna module according to one embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like. In addition, the term "connect" used herein refers to a physical connection between two elements, which can be a direct connection or an indirect connection. The term "couple" used herein refers to two elements being separated and having no physical connection, and an electric field generated by a current of one of the two elements excites that of the other one.

Figure 4:
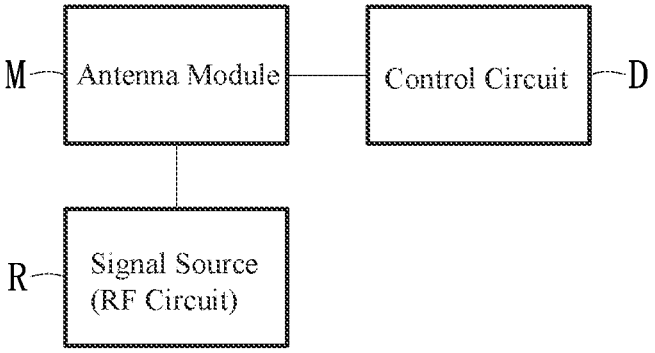
FIG. 4 is a block diagram of a control system of the antenna module of the present disclosure.
Figure 5:
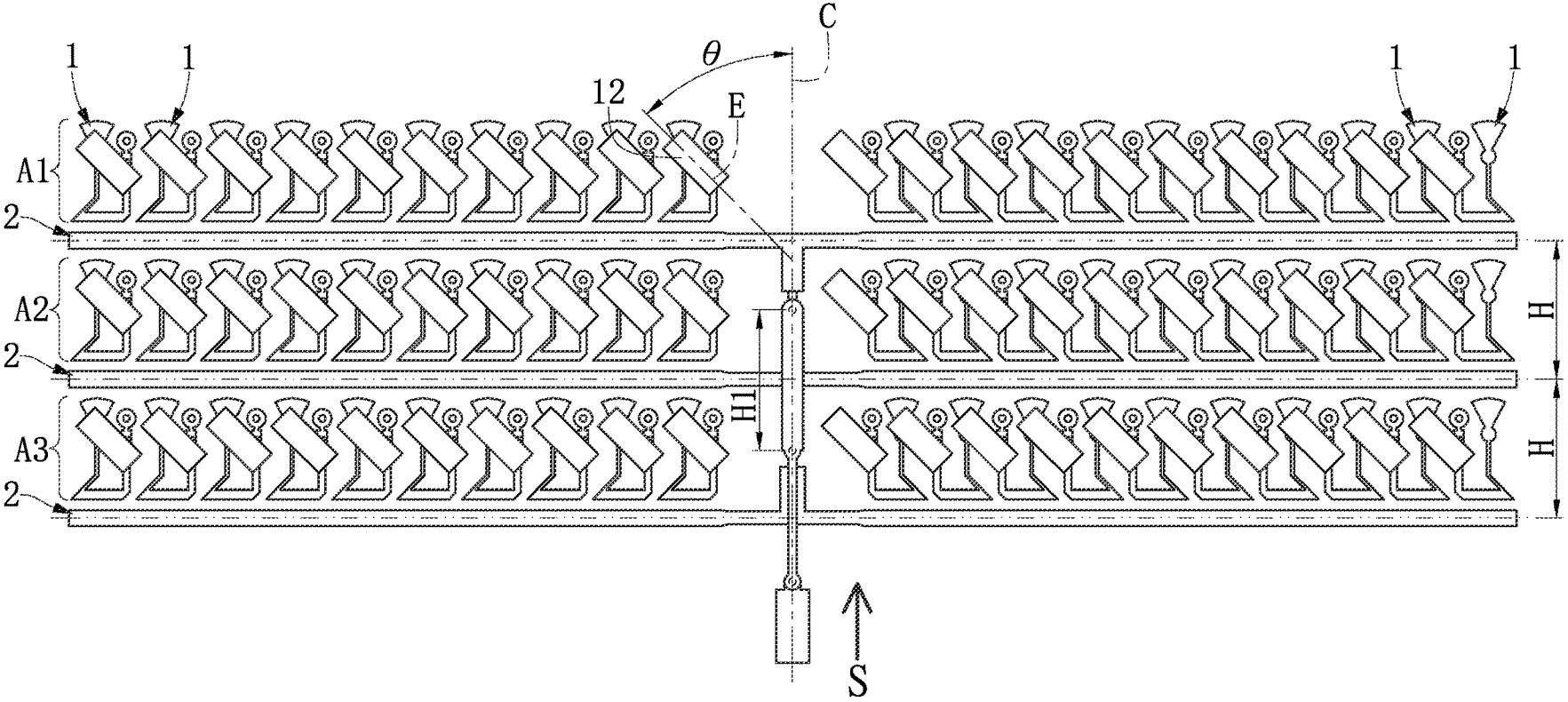
FIG. 5 is a top schematic view of an antenna array of the present disclosure.
Figure 8:
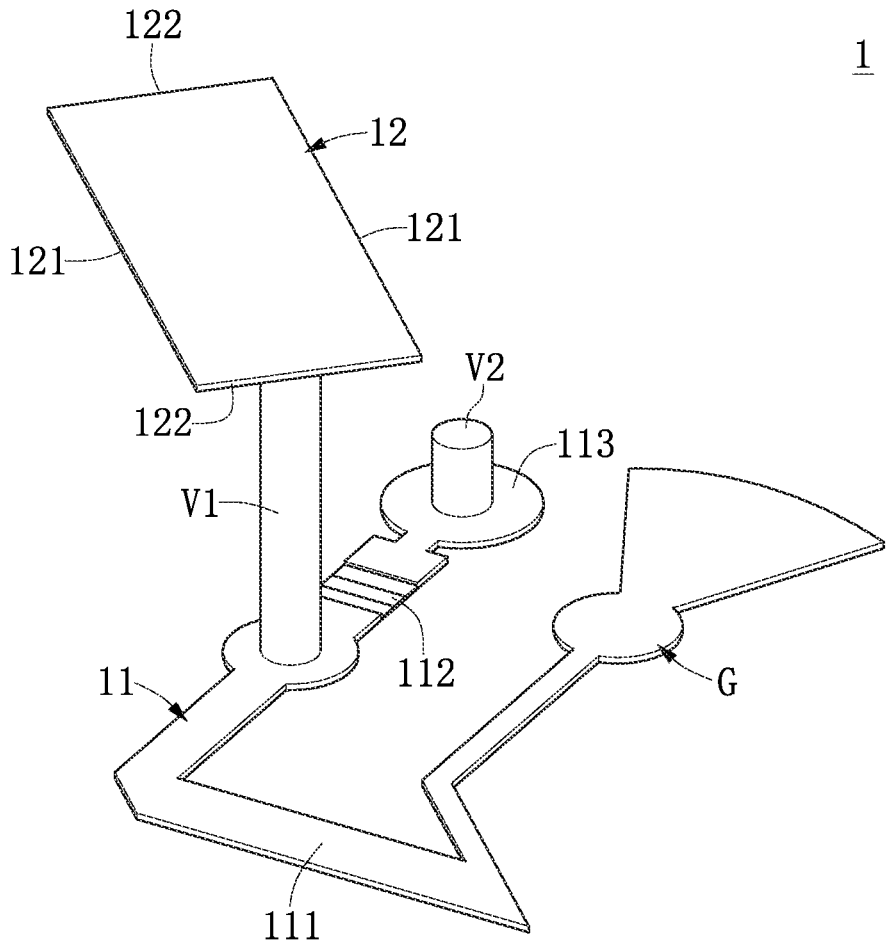
FIG. 8 is a three-dimensional schematic view of one antenna element of the antenna module of the present disclosure.
Figure 9:
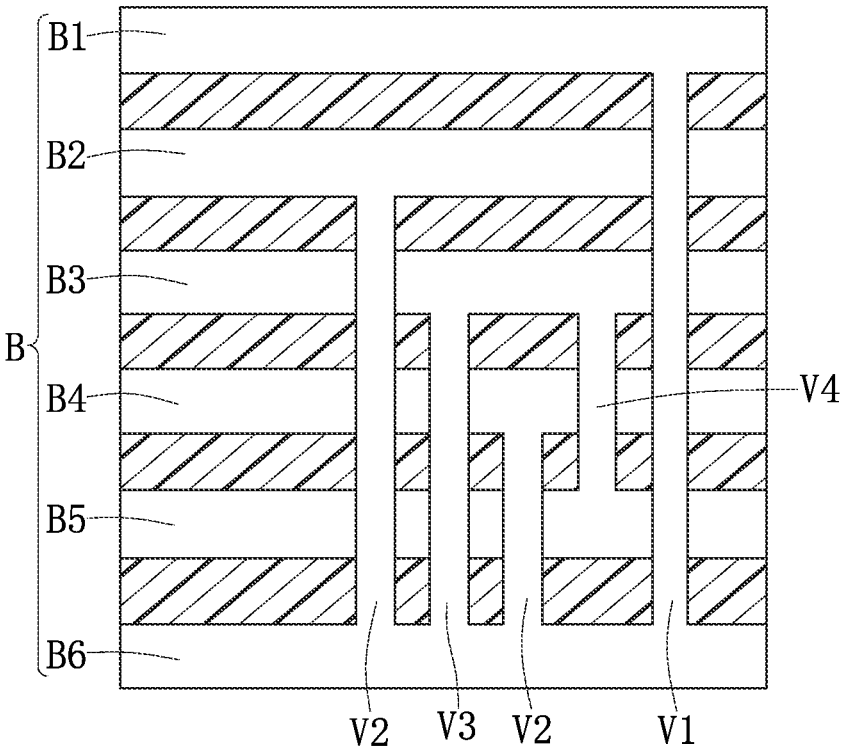
FIG. 9 is a schematic sectional view of a circuit board of the present disclosure.

Referring to FIG. 1, FIG. 1 is a three-dimensional schematic view of an antenna module according to one embodiment of the present disclosure. The present disclosure provides an antenna module M. The antenna module M includes at least one antenna array A and circuit board B. Referring to FIG. 1, FIG. 4, and FIG. 5, FIG. 4 is a block diagram of a control system of the antenna module of the present disclosure and FIG. 5 is a top schematic view of an antenna array of the present disclosure. At least one antenna array A defines a midline C which is a center line of the at least one antenna array A. At least one antenna array A includes a plurality of antenna elements 1 and a signal feeding line 2. The circuit board B has a multi-layer board structure. The plurality of antenna elements 1 and signal feeding line 2 may be disposed on the circuit board B. The signal feeding line 2 is perpendicular to the midline C. Next, referring to FIG. 8, FIG. 8 is a three-dimensional schematic view of one antenna element of the antenna module of the present disclosure. The antenna element 1 includes a feeding branch 11 and a radiating portion 12. The feeding branch 11 is disposed on the circuit board B. The radiating portion 12 is connected to the feeding branch 11 and is disposed on the circuit board B. The radiating portion 12 is exposed on an upper surface of the circuit board B. The radiating portion 12 is a rectangular patch element having two opposite long sides 121 and two short sides 122 connected between the two long sides 121. The radiating portion 12 has a design in which the long side 121 is greater than the short side 122 to reduce the coupling between two adjacent radiating portions 12 and reduce the mutual interference between the multiple radiating portions 12. In addition, the distance between two adjacent radiating portions 12 may be about 0.2 λ, and λ, is a wavelength of a signal transmitting in the air. The signal feeding line 2 is arranged in the circuit board B and perpendicular to the midline C. The signal feeding line 2 is coupling to the feeding branch 11. As shown in FIG. 4 and FIG. 5, when a signal (radio frequency signal) provided by a signal source R (radio frequency circuit) is fed into at least one antenna array A through the signal feeding line 2, at least one antenna array A may generate a radiation pattern by radiating portions 12 as antenna radiators. In addition, the antenna module M further includes a plurality of control signal lines (DC control lines) (not shown in the figure), which are respectively electrically connected between the plurality of antenna elements 1 and a control circuit D. The control circuit D adjusts a beam direction of the radiation pattern generated by the at least one antenna array A through the plurality of control signal lines.

Figure 2:
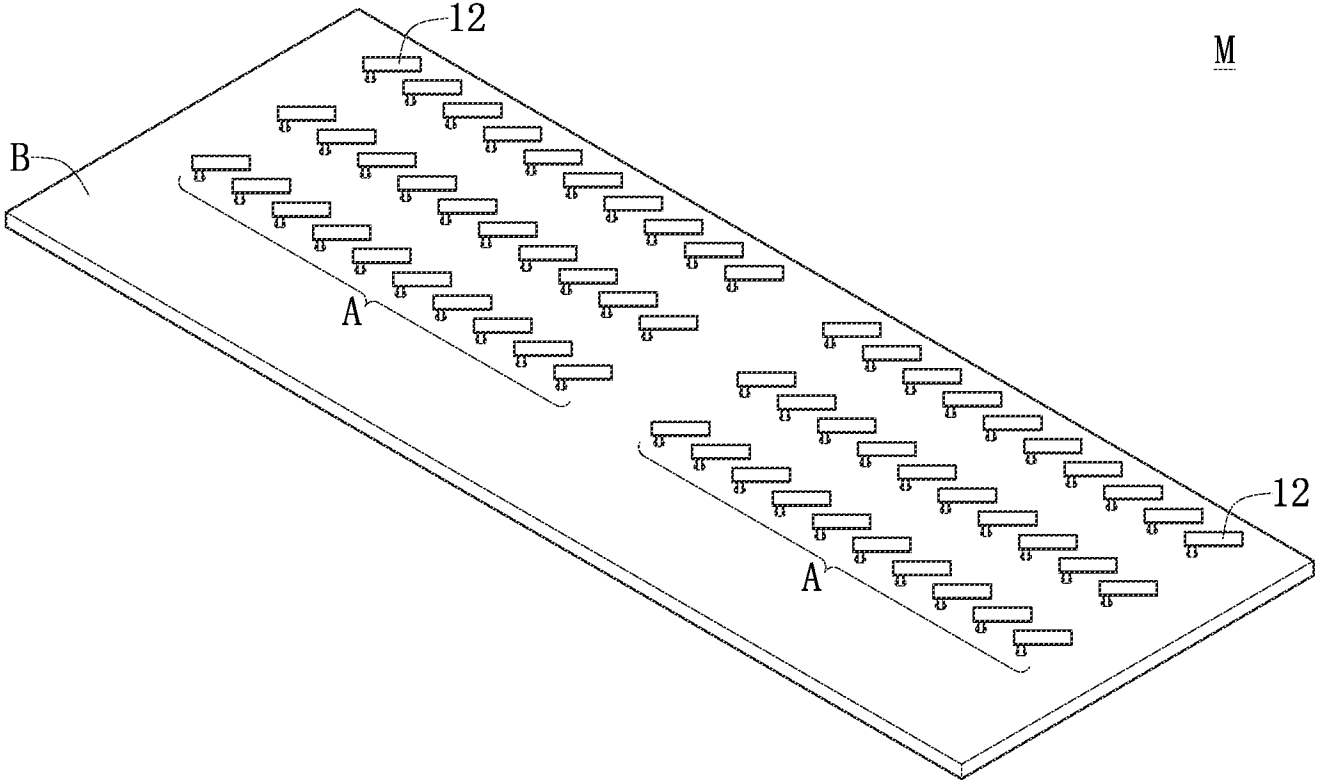
FIG. 2 is a three-dimensional schematic view of an antenna module according to another embodiment of the present disclosure.

Furthermore, the plurality of radiating portion 12 of the plurality of antenna elements 1 exposed on the circuit board B are basically arranged in the same direction. As shown in FIG. 5, the radiating portion 12 defines an extension line E along an extension direction that is parallel to the long side 121 of the radiating portion 12, so the extension line E is also configured to be parallel to the long side 121 of the radiating portion 12. There is an included angle θ between the extension line E and the midline C, and the included angle θ is used as the included angle between the radiating portion 12 and the midline C. Therefore, the included angle θ defines the direction in which the radiating portion 12 is arranged. It should be noted that the present disclosure does not limit the degree and direction of the included angle θ. Referring to FIG. 2, which is a three-dimensional schematic view of another embodiment of the antenna module of the present disclosure. Comparing FIG. 2 with FIG. 1, it can be seen that the arrangement direction of the multiple radiating portions 12 in FIG. 2 is not the same as the arrangement direction of the multiple radiating portions 12 in FIG. 1. The polarization direction of the radiation pattern generated by the at least one antenna array A in FIG. 2 is different from the polarization direction of the radiation pattern generated by the at least one antenna array A in FIG. 1. Furthermore, the antenna array A shown in FIG. 5 can be regarded as the appearance of the antenna module M in FIGS. 1 and 2 after the circuit board B is removed. In FIG. 5, when the included angle θ is negative 45 degrees, the radiating portion 12 rotates counterclockwise relative to the midline C and forms a negative 45 degree angle with the midline C, which is the same as the arrangement direction of the radiating portion 12 in FIG. 1. However, if the radiating portion 12 rotates clockwise with relative to the midline C to form a positive 45 degrees with respect to the midline C, which is the same as the arrangement direction of the radiating portion 12 in FIG. 2. Therefore, the antenna module M of the present disclosure only needs to use a single antenna array structure to achieve the effects of different polarization directions.

In this embodiment, the number of antenna arrays A is three as an example, which can be further divided into antenna array A1, antenna array A2, and antenna array A3. The number of antenna element 1 in three antenna arrays A1, A2, and A3 is 20 as an example (10 on the left and 10 on the right). The radiating portion 12 of each antenna element 1 has the same arrangement direction. However, the present disclosure is not limited to the number of antenna array A, nor is it limited to the number of antenna elements 1 in antenna array A. For example, the number of antenna array A can be one, two, or even three or more. The number of antenna elements 1 in the antenna array A may be, for example, 50 (25 on the left and 25 on the right). Therefore, when signals provided by the signal source are fed into the three antenna arrays A1, A2, and A3, respectively, through the signal feeding lines 2 of the three antenna arrays A1, A2, and A3, the three antenna arrays A1, A2, and A3 may generate a radiation pattern. The polarization direction of the radiation pattern can be changed by adjusting the arrangement direction of the radiating portion 12 of the antenna element 1 in the antenna arrays A1, A2, A3, for example, the vertical polarization direction or the horizontal polarization direction.

Figure 3:
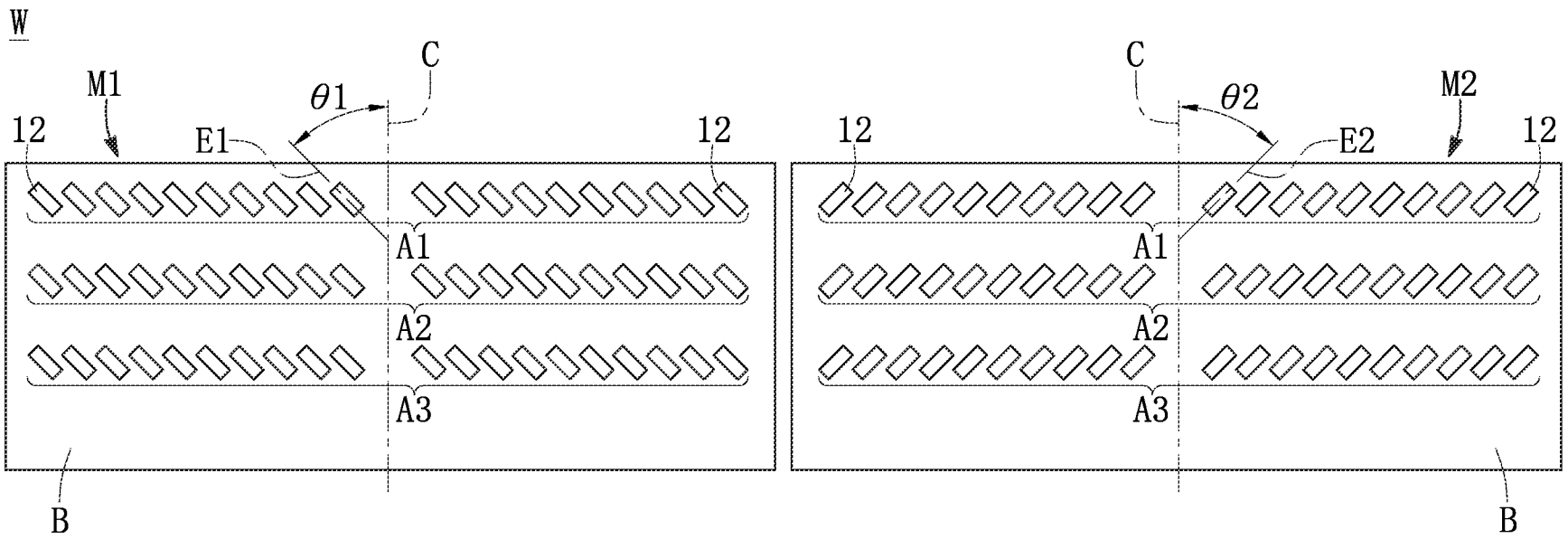
FIG. 3 is a schematic view of a first antenna module and a second antenna module of the present disclosure.

Referring to FIG. 3, the present disclosure provides a wireless transceiver device W. The wireless transceiver device W includes at least one circuit board B, a first antenna module M1 and a second antenna module M2. The first antenna module M1 and the second antenna module M2 respectively define a midline C. The first antenna module M1 and the second antenna module M2 are disposed on the at least one circuit board B. In this embodiment, the first antenna module M1 and the second antenna module M2 are respectively disposed on the two circuit boards B, but the present disclosure is not limited thereto. In other embodiments, the first antenna module M1 and the second antenna module M2 may also be disposed on the same circuit board B. The first antenna module M1 and the second antenna module M2 respectively include three antenna arrays, namely, an antenna array A1, an antenna array A2, and an antenna array A3. Furthermore, the difference between the first antenna module M1 and the second antenna module M2 is that the multiple radiating portions 12 of the multiple antenna elements 1 are arranged in different directions. A first extension direction along the radiating portions 12 in the three antenna arrays A1, A2, A3 of the first antenna module M1 defines a first extension line E1, and there is a first angle θ1 between the first extension line E1 and the midline C. A second extension direction along the radiating portions 12 in the three antenna arrays A1, A2, A3 of the second antenna module M2 defines a second extension line E2, and there is a second angle θ2 between the second extension line E2 and the midline C. As shown in FIG. 3, since the first antenna module M1 and the second antenna module M2 are arranged side by side, the midline C of the first antenna module M1 and the second antenna module M2 are parallel to each other. Therefore, the included angle between the first extension line E1 and the second extension line E2 may be (θ1+θ2), and the included angle (θ1+θ2) is equal to an included angle between the radiating portion 12 of any antenna element 1 of in the first antenna module M1 and the radiating portion 12 of any antenna element 1 of the second antenna module M2. Thereby, the wireless transceiver device W may generate two radiation patterns with dual polarization directions by adjusting the angle (θ1+θ2) between the first extension line E1 and the second extension line E2.

For example, when θ1 is negative 45 degrees and θ2 is positive 45 degrees (defined as positive when rotated clockwise relative to the midline C, and negative when rotated counterclockwise relative to the midline C), the included angle between first extension line E1 and the second extension lines E2 is 90 degrees. Therefore, when a signal provided by the signal source is fed into the three antenna arrays A1, A2, A3 of the first antenna module M1 through the signal feeding line 2, the three antenna arrays A1, A2, A3 of the first antenna module M1 generate a first radiation pattern with a first polarization direction. At the same time, when the signal provided by the signal source is fed into the three antenna arrays A1, A2, A3 of the second antenna module M2 through the signal feeding line 2, the three antenna arrays A1, A2, A3 of the second antenna module M2 generate a second radiation pattern with a second polarization direction. Therefore, when the angle between the first extension line E1 and the second extension line E2 is 90 degrees, the first polarization direction of the first radiation pattern and the second polarization direction of the second radiation pattern would be orthogonal.

Figure 6:
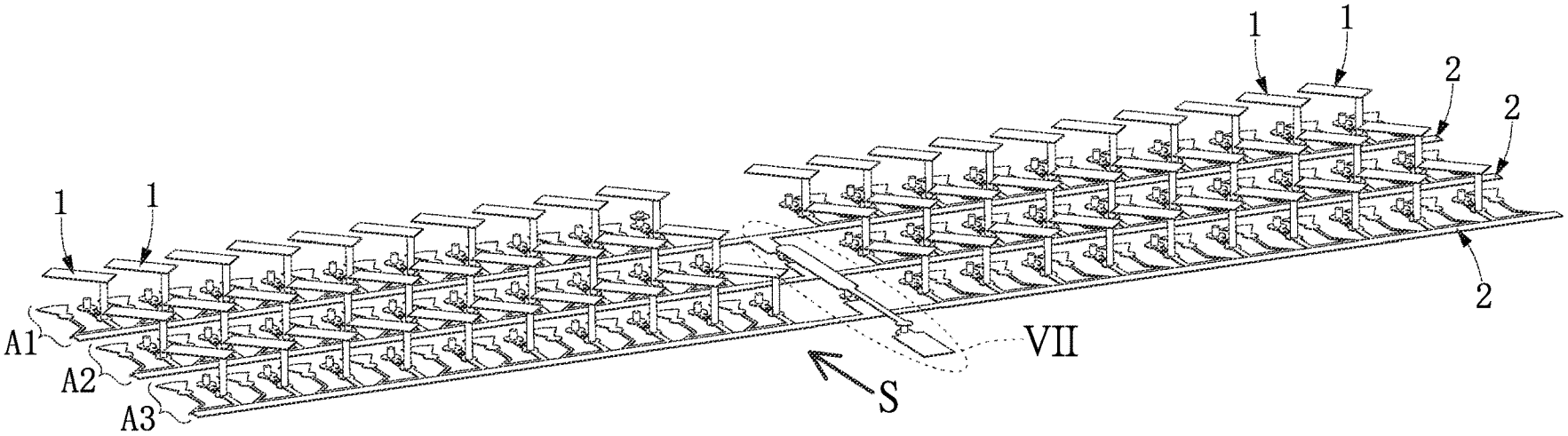
FIG. 6 is a three-dimensional schematic view of the antenna array of the present disclosure.
Figure 7:
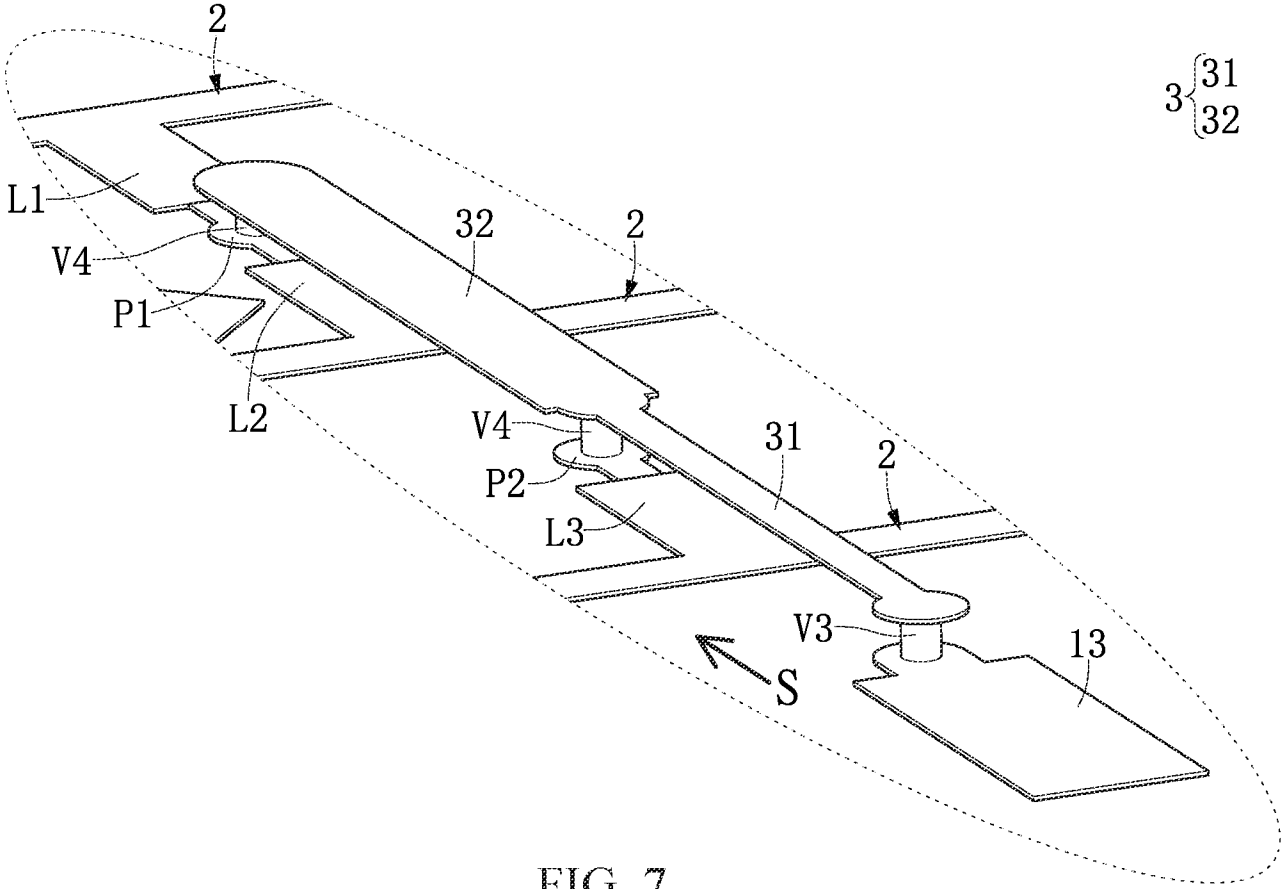
FIG. 7 is an enlarged partial view of part VII of FIG. 6.

Next, referring to FIGS. 5, 6 and 7 together. FIG. 1 is a three-dimensional schematic view of the antenna array of the present disclosure. FIG. 7 is an enlarged partial view of part VII of FIG. 6. The antenna module M further includes a power divider 3 and a microstrip line 13. The power divider 3 is electrically connected between the signal feeding line 2 and the signal source. Furthermore, the microstrip line 13 is electrically connected between the signal source and the signal feeding line 2, and the power divider 3 is electrically connected between the signal feeding line 2 and the microstrip line 13. The signal generated by the signal source is fed into the microstrip line 13 along the signal transmission direction S, and then transmitted to each signal feeding line 2 through the power divider 3, and then coupling to multiple antenna elements 1 through each signal feeding line 2.

The signal is transmitted by the radiating portions 12 of the multiple antenna elements 1. The power divider 3 includes a first transmission section 31 and a second transmission section 32 connected to each other. For example, the microstrip line 13 may be a 50 Ω microstrip line, the first transmission section 31 of the power divider 3 may be a quarter-wavelength converter. The second transmission section 32 may be a 25 ohm microstrip line and the length H1 of the second transmission section 32 can be determined according to the transmission distance when the signal reaches a phase of 360 degrees. During the signal transmission on the second transmission section 32, the distance traveled when the signal phase reaches 360 degrees is determined as the length H1 of the second transmission section 32. Therefore, the second transmission section 32 has a phase adjustment range of 360 degrees. In addition, among the three antenna arrays A1, A2, and A3 of the antenna module M, the antenna array A1 has a connection segment L1, the antenna array A2 has a connection segment L2, and the antenna array A3 has a connection segment L3. The two connecting sections L1 and L2 of the two of antenna arrays A1 and A2 intersect at an intersection point P1 and are electrically connected to one end of the second transmission section 32 through the intersection point P1. The connection segment L3 of the remaining antenna array A3 is electrically connected between the first transmission section 31 and the second transmission section 32 through a connection point P2. It can be seen from FIG. 7 that the distance between the intersection point P1 and the connection point P2 is equal to the length H1 of the second transmission section 32, so the phase difference between the intersection point P1 and the connection point P2 is 360 degrees, that is, the same phase. It should be noted that the lengths of the connection segments L1, L2, and L3 in FIG. 7 are only for reference and do not represent the actual lengths. In this embodiment, since the sizes of the connecting sections L1, L2, and L3 are all the same, the signal is transmitted to the intersection point P1 and the connection point P2 then reaching the three antenna arrays A1, A2, and A3, and signal is basically in the same phase (or a phase difference of 360 degrees). The three antenna arrays A1, A2, and A3 are arranged side by side with a predetermined distance H apart. When the three antenna arrays A1, A2, and A3 are basically in phase, the predetermined distance H is between plus and minus 10% of the length H1 of the second transmission section 32. Preferably, the predetermined distance H is equal to the length H1 of the second transmission section 32. In this way, the present disclosure determines the predetermined distance H by the distance traveled when the signal reaches a phase of 360 degrees, so as to ensure that the signal provided by the signal source is transmitted to the three antenna arrays A1, A2, and A3 with the same phase.

Furthermore, the length of the first transmission section 31 is 0.25 times the wavelength corresponding to an operating frequency generated by the signal source, and the length H1 of the second transmission section is determined by a wavelength corresponding to the operating frequency and a dielectric constant of the circuit board B. Specifically, the relationship between the length H1 of the second transmission section 32, the wavelength, operating frequency, and dielectric coefficient is: $H1=\lambda_0/(\epsilon_r)^{1/2}$; where λ0 is the wavelength corresponding to the operating frequency generated by the signal source in vacuum, $\epsilon_r$ is the dielectric constant of the circuit board B. For example, the operating frequency may be 28 GHz, and λ0 is the wavelength corresponding to the operating frequency of 28 GHz in vacuum. In addition, the width of the second transmission section 32 is greater than the width of the first transmission section 31, thereby ensuring that the signal source transmits to the three antenna arrays A1, A2, and A3 with the same energy (that is, the signal strength is 1:1:1).

Next, referring again to FIG. 8, as mentioned above, the antenna element 1 includes the feeding branch 11 and the radiating portion 12. The feeding branch 11 includes a coupling portion 111, a varactor 112 and a grounding portion 113. The varactor 112 is connected between the coupling portion 111 and the ground portion 113. The radiating portion 12 also has a conductive via hole V1, which is connected between the coupling portion 111 and the varactor 112, but the present disclosure is not limited to this. In other embodiments, a conductive pillar is electrically connected between the coupling portion 111 and the varactor 112. That is, the conductive via hole V1 is not a through hole but a conductive pillar. The coupling portion 111 and the signal feeding line 2 are separated from each other and coupling to each other. Furthermore, the multiple control signal lines of the antenna module M are respectively connected between the multiple antenna elements 1 and a control circuit D. One end of each control signal line is connected to the control circuit D, and the other end is connected to a conductive pad G on the antenna element 1. The control circuit D may control the switching operations of the varactors 112 through the control signal lines. It should be noted that each varactor 112 operates independently, and its switching operation is not affected by other varactor 112. Next, the operation mechanism of the varactor 112 is further explained. In this embodiment, the anode of the varactor 112 is connected to the grounding portion 113 and the cathode of the varactor 112 is connected to the feeding branch 11. When the control circuit D controls the antenna element 1 to be in the on-state, the control circuit D would not apply a voltage to the varactor 112, the capacitance of the varactor 112 is larger, and an impedance matching is formed between the feeding branch 11 and signal feeding line 2. Therefore, the signal is transmitted to the feeding branch 11 and radiating portion 12 through the coupling between the signal feeding line 2 and the coupling portion 111. The antenna element 1 is capable of transceiving the signal. Conversely, when the control circuit D controls the antenna element 1 to be in an off-state, the control circuit D would apply a voltage to the varactor 112, the capacitance of the varactor 112 becomes smaller, an impedance mismatching is formed between the feeding branch 11 and signal feeding line 2. Therefore, the signal is hardly transmitted to the feeding branch 11 and radiating portion 12 through the coupling between the signal feeding line 2 and the coupling portion 111. The antenna element 1 is incapable of transceiving the signal. In this way, the control circuit D can control the switching operation of each varactor 112 through the control signal lines to change the signal receiving state of the radiating portion 12 corresponding to each varactor 112, thereby adjusting a beam direction of the radiation pattern generated by the antenna array.

Next, referring to FIGS. 6 to 9, FIG. 9 is a schematic sectional view of a circuit board of the present disclosure. The circuit board B includes a multi-layer board structure, which includes a first layer B1, a second layer B2, a third layer B3, a fourth layer B4, a fifth layer B5, and a sixth layer B6 stacked from top to bottom. The components of the antenna element 1, the signal feeding line 2 and the power divider 3 are respectively arranged in different layers, and are electrically connected through a plurality of conductive via holes in the circuit board B. The signal feeding line 2 (including the connection segments L1, L2, and L3) is disposed on the fifth layer B5. The microstrip line 13 and the coupling portion 111 of the feeding branch 11, the varactor 112 and the grounding portion 113 are disposed on the sixth layer B6. The ground portion 113 is electrically connected to a grounding area (not shown in the figure) of the fourth layer B4 or the second layer B2 through the conductive via hole V2. The radiating portion 12 is disposed on the first layer B1 and is exposed on an upper surface of the first layer B1. The power divider 3 is disposed on the third layer B3. A part of each of the control signal lines is disposed on the third layer B3 and the other part is disposed on the sixth layer B6. For example, the signal provided by the signal source is fed to the microstrip line 13 disposed on the sixth layer B6, and is transmitted to the power divider 3 disposed on the third layer B3 through the conductive via hole V3 and is performed signal shunting. Among them, one-third of the signal is transmitted to the connection point P2 of the connection segment L3 through the conductive via V4 which is between the first transmission section 31 and the second transmission section 32 of the power divider 3, and then transmitted to the signal feeding line 2 of the antenna array A3. Two-thirds of the signal is transmitted through one end of the second transmission section 32 to the intersection point P1 where the two connection segments L1, L2 of the two antenna arrays A1, A2 intersect and are transmitted through the conductive via hole V4. Then, the two-thirds of the signal transmitted to the two signal feeding lines 2 of the two antenna arrays A1 and A2 is divided evenly.

One of the beneficial effects of the present disclosure is that the antenna module M provided by the present disclosure can adopt the technical solution of "the radiating portion 12 defines an extension line E along its extension direction, and there is an angle between the extension line E and the midline C", In this way, the antenna module can generate radiation patterns with different polarization directions based on the same architecture, saving the time and cost required for antenna fine-tuning.

One of the beneficial effects of the present disclosure is that the wireless transceiving device w provided by the present disclosure can utilize "the first antenna module M1 and the second antenna module M2 are both disposed on at least one circuit board B, and the first antenna module M1 and the second antenna module M2 respectively include at least one antenna array A, the at least one antenna array A includes a plurality of antenna elements 1 and a signal feeding line 2" and "a first extension direction along the radiating portion 12 of the at least one antenna array A of the first antenna module M1 defines a first extension line E1, a second extension direction along the radiating portion 12 of the at least one antenna array A of the second antenna module M2 defines a second extension line E2, and there is an included angle of 90 degrees between the first extension line E1 and the second extension line E2" technical solution, so that the first antenna module M1 and the second antenna module M2 may generate dual-polarization radiation patterns based on the same architecture, saving the time and cost of antenna fine-tuning.

Furthermore, in the present disclosure, three antenna arrays A1, A2, and A3 are arranged side by side with a predetermined distance H apart, and the predetermined distance H is between plus and minus 10% of the length H1 of the second transmission section 32. The length H1 of the transmission section 32 is equal to the wavelength corresponding to the signal provided by the signal source. In this way, it can be ensured that the signal provided by the signal source has the same phase when transmitted to the three antenna arrays A1, A2, and A3. More specifically, the control circuit D can control the switching operation of each varactor 112 through the control signal lines to change the signal receiving state of the radiating portion 12 corresponding to each varactor 112, thereby adjusting a beam direction of the radiation pattern generated by the three antenna arrays A1, A2, and A3.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An antenna module, comprising:

a circuit board, having a multi-layer board structure; and;

at least one antenna array, defining a midline of the at least one antenna array, the at least one antenna array including:

a plurality of antenna elements, each of the plurality of antenna elements having a feeding branch and a radiating portion, the feeding branch disposed on the circuit board, the feeding branch including a coupling portion, the radiating portion connecting to the feeding branch and disposed on the circuit board, and the radiating portion exposed on an upper surface of the circuit board; and a signal feeding line, disposed on the circuit board and perpendicular to the midline, and the signal feeding line coupling to the feeding branch, wherein the coupling portion is separate from the signal feeding line and is coupling to the signal feeding line; and a power divider electrically connected between the signal feeding line and a signal source:

wherein, when a signal provided by the signal source is fed into the at least one antenna array through the signal feeding line, the at least one antenna array generates a radiation pattern;

wherein an extension direction along the radiating portion defines an extension line and there is an included angle between the extension line and the midline;

wherein the feeding branch of each of the antenna elements, the radiating portion of each of the antenna elements, the signal feeding line, and the power divider are respectively arranged in different layers of the multi-layer board structure.

2. The antenna module of claim 1, wherein the feeding branch includes a varactor and a grounding portion, the varactor is connected between the radiating portion and the grounding portion, and the radiating portion is connected between the coupling portion and the varactor.

3. The antenna module of claim 2, further comprising a plurality of control signal lines, the plurality of varactors electrically connected to a control circuit through the plurality of control signal lines and controlled by the control circuit to change a beam direction of the radiation pattern.

4. The antenna module of claim 3, wherein the signal provided by the signal source having an operating frequency, the power divider including a first transmission section and a second transmission section connected to each other, and a length of the second transmission section is determined by a wavelength corresponding to the operating frequency and a dielectric constant of the circuit board, and a width of the second transmission section being greater than a width of the first transmission section.

5. The antenna module of claim 1, wherein the multi-layer board structure includes a first layer, a second layer, a third layer, a fourth layer, a fifth layer, and a sixth layer stacked from top to bottom, the signal feeding line is arranged on the fifth layer, the coupling portion, the varactor and the grounding portion are arranged on the sixth layer, the grounding portion is electrically connected to a grounding section of the fourth layer or the second layer, the radiating portion is arranged on the first layer and exposed on an upper surface of the first layer, the plurality of the control signal lines are arranged on the third layer, and the power divider is arranged on the third layer.

6. The antenna module of claim 5, wherein a number of the at least one antenna array is three, each of the antenna arrays includes a connection segment, two connection segments of the two antenna arrays intersect at an intersection point, one end of the second transmission section is electrically connected to the intersection point, and the connection segment of the remaining antenna array is electrically connected between the first transmission section and the second transmission section.

7. The antenna module of claim 6, wherein the antenna arrays are arranged side by side and separated by a predetermined distance and the predetermined distance is between plus or minus 10% of the length of the second transmission section.

8. The antenna module of claim 1, wherein the included angle is 45 degrees.

9. The antenna module of claim 1, wherein the radiating portion is a rectangular patch element having a long side and a short side, and a length of the long side is greater than twice a length of the short side.

10. A wireless transceiver device, comprising:

at least one circuit board having a multi-layer board structure; and a first antenna module and a second antenna module, each defining a midline, the first antenna module and the second antenna module disposed on the at least one circuit board, and the first antenna module and the second antenna module respectively include:

at least one antenna array, comprising:

a plurality of antenna elements, each of the plurality of antenna elements having a feeding branch and a radiating portion, the feeding branch disposed on the circuit board, the feeding branch including a coupling portion, the radiating portion connecting to the feeding branch and disposed on the circuit board, and the radiating portion exposed on an upper surface of the circuit board; and;

a signal feeding line, disposed on the circuit board and perpendicular to the midline, and the signal feeding line coupling to the feeding branch, wherein the coupling portion is separate from the signal feeding line and is coupling to the signal feeding line; and a power divider electrically connected between the signal feeding line and a signal source:

wherein, when a signal provided by the signal source is fed into the at least one antenna array of the first antenna module through the signal feeding line of the first antenna module, the at least one antenna array of the first antenna module generates a first radiation pattern;

wherein, when another signal provided by the signal source is fed into the at least one antenna array of the second antenna module through the signal feeding line of the second antenna module, the at least one antenna array of the second antenna module generates a second radiation pattern, and a polarization direction of the second radiation pattern is orthogonal to a polarization direction of the first radiation pattern;

wherein a first extension direction along the radiating portion of the at least one antenna array of the first antenna module defines a first extension line, a second extension direction along the radiating portion of the at least one antenna array of the second antenna module defines a second extension line, and there is an included angle of 90 degrees between the first extension line and the second extension line;

wherein the feeding branch of each of the antenna elements, the radiating portion of each of the antenna elements, the signal feeding line, and the power divider are respectively arranged in different layers of the multi-layer board structure.

11. The wireless transceiver device of claim 10, wherein the feeding branch includes a varactor and a grounding portion, the varactor is connected between the radiating portion and the grounding portion, and the radiating portion is connected between the coupling portion and the varactor.

12. The wireless transceiver device of claim 11, wherein the first antenna module and the second antenna module respectively comprise a plurality of control signal lines, and the plurality of varactors of the first antenna module and the second antenna module are electrically connected to a control circuit through the plurality of control signal lines and controlled by the control circuit to change a beam direction of the first radiation pattern or a beam direction of the second radiation pattern.

13. The wireless transceiver device of claim 10, wherein the multi-layer board structure includes a first layer, a second layer, a third layer, a fourth layer, a fifth layer, and a sixth layer stacked from top to bottom, the signal feeding line is arranged on the fifth layer, the coupling portion, the varactor and the grounding portion are arranged on the sixth layer, the grounding portion is electrically connected to a grounding section of the fourth layer or the second layer, the radiating portion is arranged on the first layer and exposed on an upper surface of the first layer, the plurality of the control signal lines are arranged on the third layer, and the power divider is arranged on the third layer.

14. The wireless transceiver device of claim 13, wherein the number of the at least one circuit board is two, and the first antenna module and the second antenna module are respectively disposed on the two circuit boards.

15. The wireless transceiver device of claim 13, wherein a number of the at least one antenna array of the first antenna module and a number of the at least one antenna array of the second antenna module are three, each of the antenna arrays includes a connection segment, two connection segments of the two antenna arrays of the first antenna module or two connection segments of the two antenna arrays of the second antenna module intersect at an intersection point, one end of the second transmission section is electrically connected to the intersection point, and the connection segment of the remaining antenna array of the first antenna module or the connection segment of the remaining antenna array of the second antenna module is electrically connected between the first transmission section and the second transmission section.

16. The wireless transceiver device of claim 15, wherein the three antenna arrays of the first antenna module are arranged side by side and separated by a predetermined distance, the three antenna arrays of the second antenna module are arranged side by side and separated by the predetermined distance, and the predetermined distance is between plus or minus 10% of the length of the second transmission section.

17. The wireless transceiver device of claim 10, wherein there is a first included angle between the first extension line and the midline of the first antenna module, there is a second included angle between the second extension line and the midline of the second antenna module, and the first included angle and the second included angle are both 45 degrees.

18. The wireless transceiver device of claim 10, wherein the radiating portion is a rectangular patch element having a long side and a short side, and a length of the long side is greater than twice a length of the short side.

* * * * *